US005305536A

United States Patent [19]

Depping

[11] Patent Number: 5,305,536

[45] Date of Patent: Apr. 26, 1994

[54] SHOE CLEAT GUARD HAVING A SPRING BIASED SECURING DEVICE

[76] Inventor: Carl L. Depping, 1448 School Ave., Walla Walla, Wash. 99362

[21] Appl. No.: 72,077

[22] Filed: Jun. 7, 1993

[51] Int. Cl.[5] ..... A43B 5/00

[52] U.S. Cl. ..... 36/135; 36/7.5; 36/30 R

[58] Field of Search ..... 36/135, 11.5, 7.5, 15, 36/30 R, 127, 126, 129, 132, 7.1 R, 25 R, 103

[56] References Cited

U.S. PATENT DOCUMENTS

| | | | |
|---|---|---|---|
| 2,076,316 | 4/1937 | Beals, Jr. | 36/135 |
| 3,020,654 | 2/1962 | McCann | 36/135 |
| 3,243,902 | 4/1966 | Chapman | 36/135 |
| 3,283,424 | 11/1966 | Struntz | 36/135 |
| 3,739,501 | 6/1973 | Barrett, Jr. | 36/11.5 |
| 3,913,243 | 10/1975 | Arnold et al. | 36/135 |
| 3,964,180 | 6/1976 | Cortese | 36/135 |
| 4,694,591 | 9/1987 | Blanich et al. | 36/30 R |
| 4,817,302 | 4/1989 | Saltsman | 36/11.5 |
| 4,967,750 | 11/1990 | Cherniak | 36/11.5 |

FOREIGN PATENT DOCUMENTS

| | | | |
|---|---|---|---|
| 2520988 | 8/1983 | France | 36/135 |

*Primary Examiner*—Paul T. Sewell
*Assistant Examiner*—Thomas P. Hilliard
*Attorney, Agent, or Firm*—Leon Gilden

[57] ABSTRACT

A protective body is arranged for projection onto cleats of an associated athletic shoe, such that the body includes a first layer of a first durameter arranged to receive in a piercing manner the cleats such that a second layer of a second durameter measurement greater than the first durameter measurement is arranged to effect impalement of the cleats therewithin, with a third layer mounted coextensively to the second layer of a third durameter greater than the second durameter measurement for providing for a rigid support surface. A strap member is mounted through the layers for securement to the athletic shoe structure.

1 Claim, 4 Drawing Sheets

SHOE CLEAT GUARD HAVING A SPRING BIASED SECURING DEVICE

BACKGROUND OF THE INVENTION

1. Field of the Invention

The field of invention relates to cleat guard apparatus, and more particularly pertains to a new and improved shoe cleat guard wherein the same is arranged to afford protection to underlying surfaces in mounting the guard structure to an associated athletic shoe having cleats and spikes.

2. Description of the Prior Art

Cleat guard structure of various types is available in the prior art and exemplified by the U.S. Pat. Nos. 4,872,273; 5,070,631; and 4,484,398 as examples, wherein the instant invention attempts to overcome deficiencies of the prior art by providing for a cleat guard structure arranged to be pierced by cleats of an associated shoe to insure securement and positioning of the cleats in a non-slip relationship relative to the guard structure and in this respect, the present invention substantially fulfills this need.

SUMMARY OF THE INVENTION

In view of the foregoing disadvantages inherent in the known types of cleat protective cover structure now present in the prior art, the present invention provides a shoe cleat guard arranged for piercing by the cleats of an associated athletic shoe for spacing and protecting the cleats relative to an underlying surface. As such, the general purpose of the present invention, which will be described subsequently in greater detail, is to provide a new and improved shoe cleat guard which has all the advantages of the prior art cleat guard apparatus and none of the disadvantages.

To attain this, the present invention provides a protective body arranged for projection onto cleats of an associated athletic shoe, such that the body includes a first layer of a first durameter arranged to receive in a piercing manner the cleats such that a second layer of a second durameter measurement greater than said first durameter measurement is arranged to effect impalement of the cleats therewithin, with a third layer mounted coextensively to the second layer of a third durameter greater than said second durameter measurement for providing for a rigid support surface. A strap member is mounted through the layers for securement to the athletic shoe structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe cleat guard which has all the advantages of the prior art cleat guard apparatus and none of the disadvantages.

It is another object of the present invention to provide a new and improved shoe cleat guard which may be easily and efficiently manufactured and marketed.

It is a further object of the present invention to provide a new and improved shoe cleat guard which is of a durable and reliable construction.

An even further object of the present invention is to provide a new and improved shoe cleat guard which is susceptible of a low cost of manufacture with regard to both materials and labor, and which accordingly is then susceptible of low prices of sale to the consuming public, thereby making such shoe cleat guards economically available to the buying public.

Still yet another object of the present invention is to provide a new and improved shoe cleat guard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
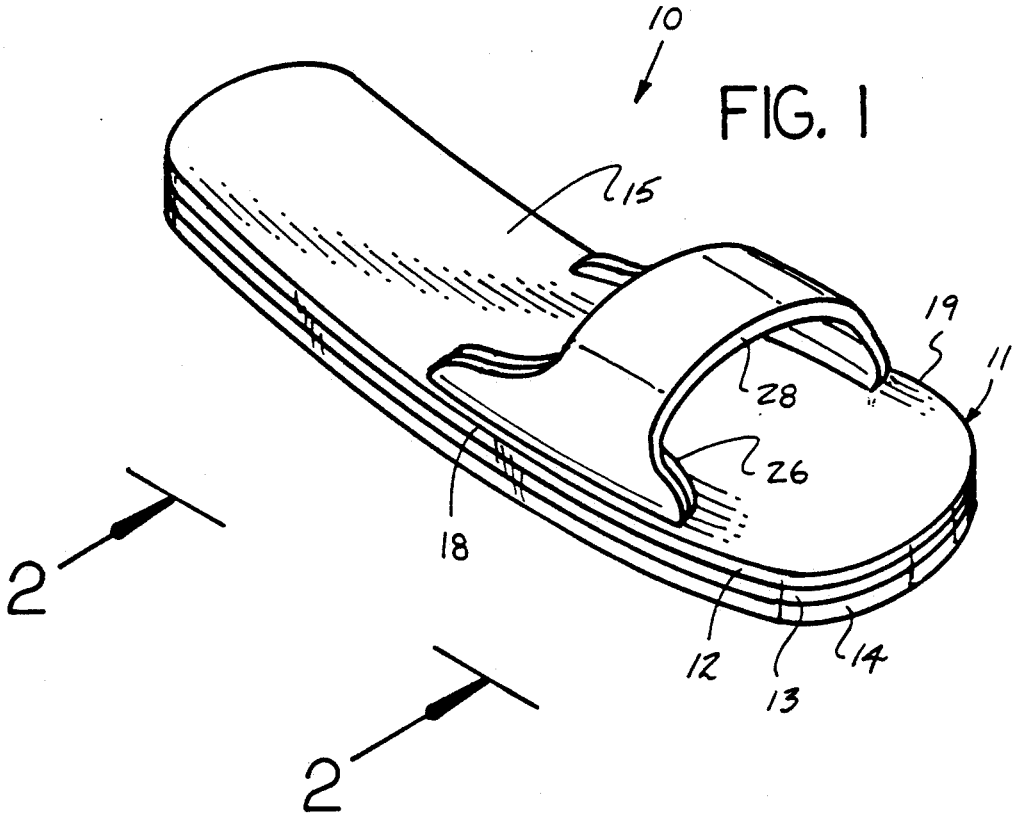
FIG. 1 is an isometric illustration of the invention.

With reference now to the drawings, and in particular to FIGS. 1 to 7 thereof, a new and improved shoe cleat guard embodying the principles and concepts of the present invention and generally designated by the reference numeral 10 will be described.

More specifically, the shoe cleat guard 10 of the instant invention essentially comprises an arcuate body 11, having a first layer 12 of an arcuate configuration, having a first durameter of hardness coextensive with a second layer 13 of a second durameter of hardness greater than said first durameter of hardness, and a third layer 15 coextensive with the first and second layers, with the third layer 14 having a third durameter of hardness greater than said second durameter of hardness. In this manner, a supporting shoe 17 having a plurality of shoe cleats 17*a* are arranged to pierce the first layer 12, typically of a sponge-like construction, through the first layer concave top wall 15, and arranged for impaling within the second layer 13 spaced from the third layer, wherein the third layer includes a third layer convex bottom wall 16. The arcuate configuration enhances projection and engagement of the heel and toe portions of the body 11 relative to the shoe structure 17.

Figure 2:
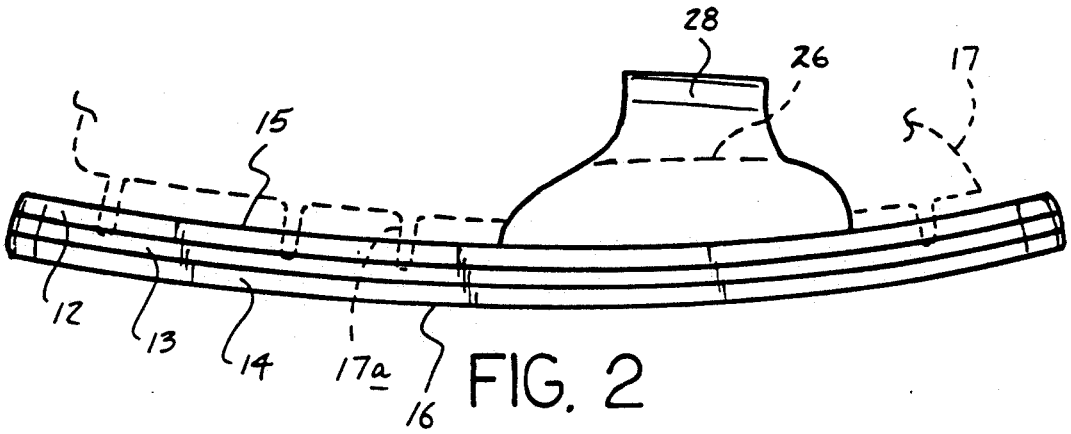
FIG. 2 is an orthographic side view, taken along the lines 2—2 of FIG. 1 in the direction indicated by the arrows.
Figure 3:
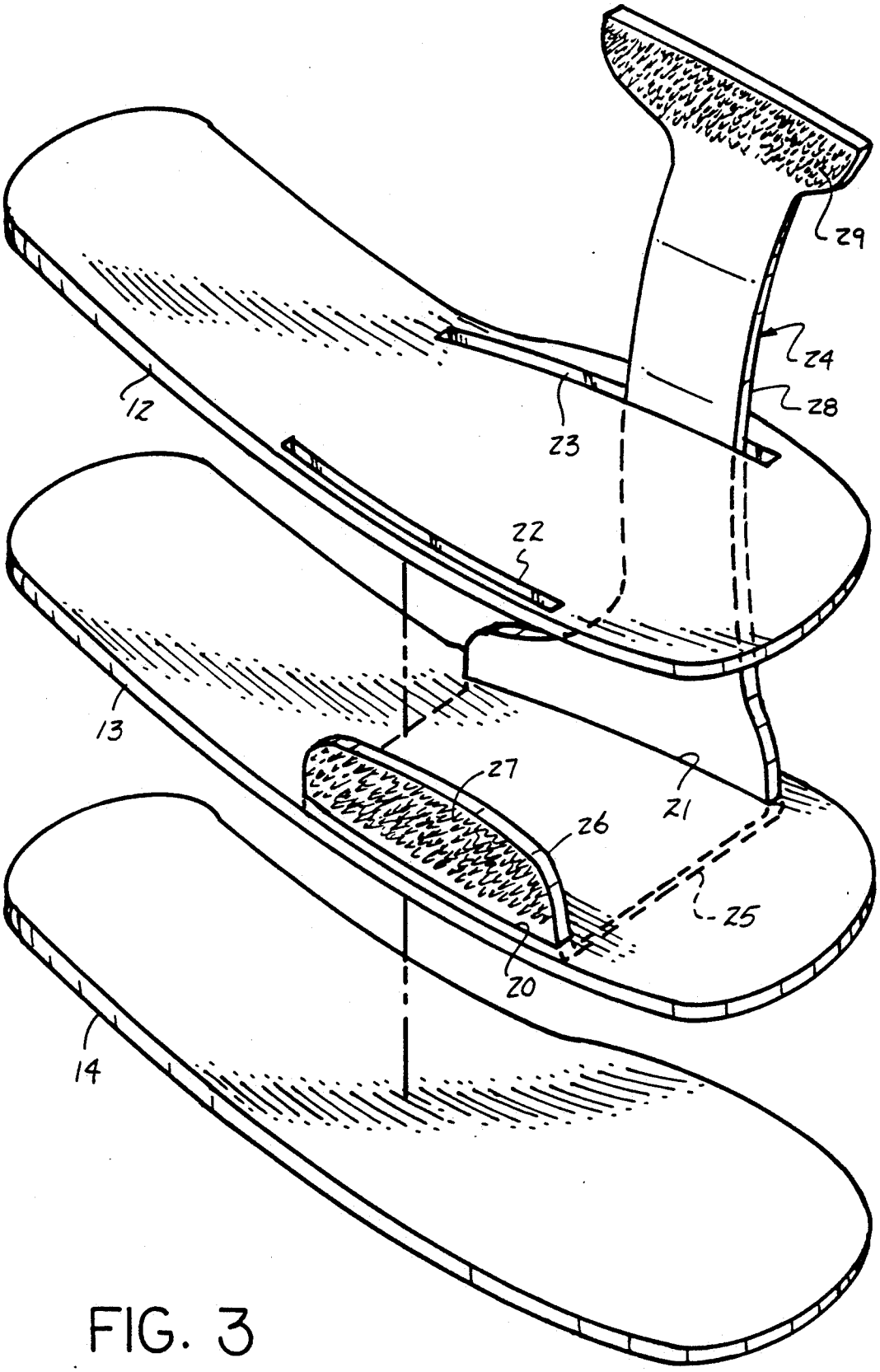
FIG. 3 is an isometric exploded illustration of the invention.

The first layer 12 includes first layer first and second side walls 18 and 19, having first layer first and second slots 22 and 23 directed therethrough that are coextensive with second layer first and second slots 20 and 21. A connecting strap 24 is provided, having a central web 25 captured between the second and third layers 13 and 14, with the central web 25 having a first web 26 of a first length extending through the second and first layer first slots 20 and 22 respectively, such that the central web 25 having a second web 28 of a second length greater than said first length extends through the second and first layer second slots 21 and 23. The first web 26 includes a first web hook and loop fastener surface 27 cooperative with a second web hook and loop fastener surface 29 that is arranged for projection about the associated sporting shoe 17, in a manner as indicated in FIG. 2 for example.

Figure 4:
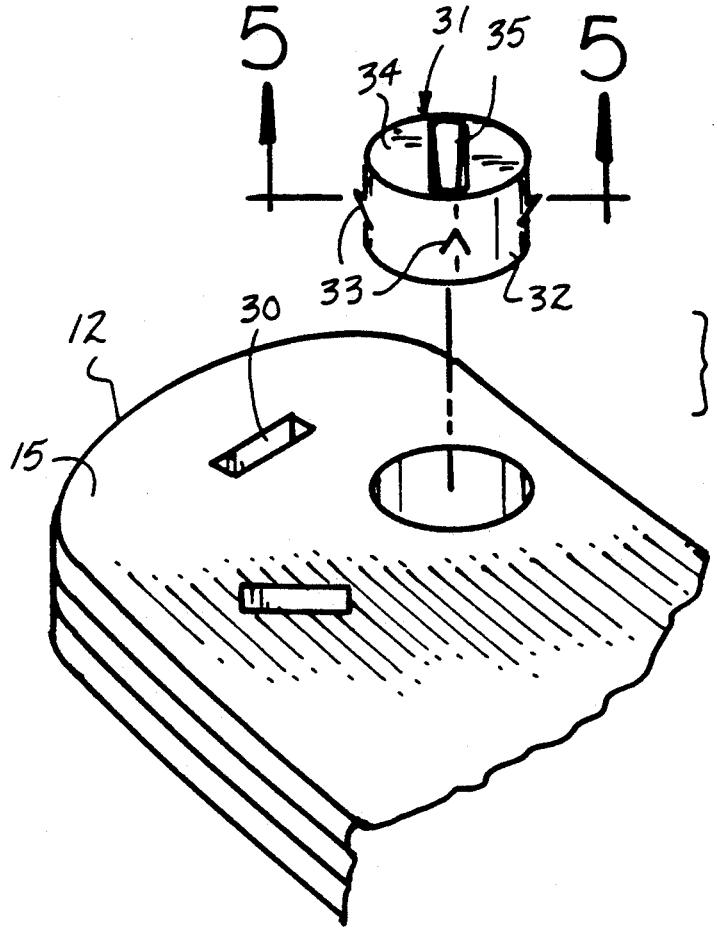
FIG. 4 is an isometric illustration of the invention including inserts arranged to receive the cleats of all associated athletic shoe.
Figure 5:
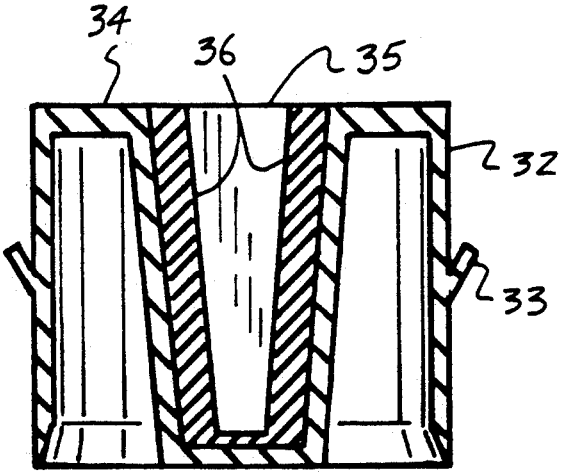
FIG. 5 is an orthographic view, taken along the lines 5—5 of FIG. 4 in the direction indicated by the arrows.

The FIG. 4 indicates the use of insert housings 31 for sharpening purposes such that cleat openings 30 directed into the first and second layers 12 and 13 provide orientation for positioning of the insert housings 31, such as an insert housing 31 includes an insert housing side wall 32 having barbed projections 33 to secure the insert housings 31 within openings. The housing 31 includes a housing top wall 34, having a top wall slot 35 accessing carbide slot side walls 36 for sharpening of cleats directed into the top wall slot 35.

Figure 6:
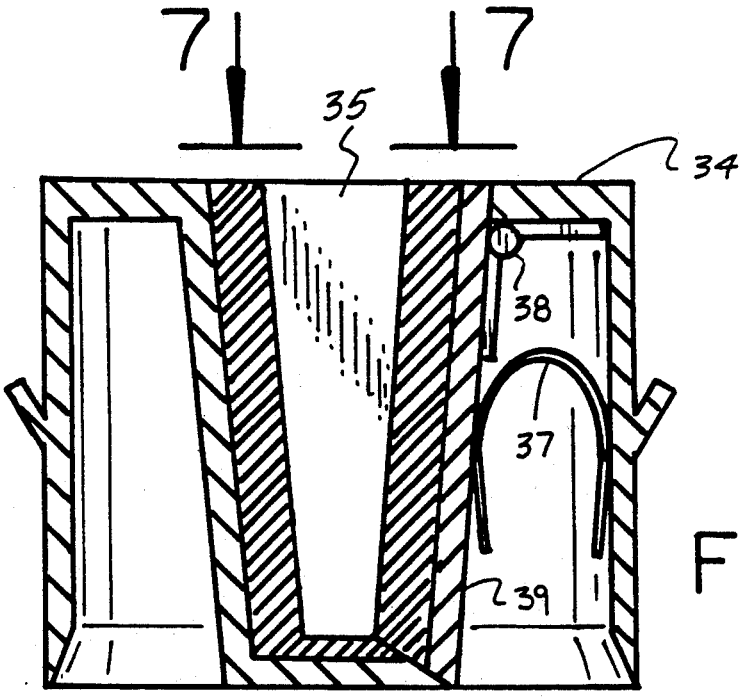
FIG. 6 is an isometric illustration of a modified insert structure, as indicated with reference to FIG. 5.
Figure 7:
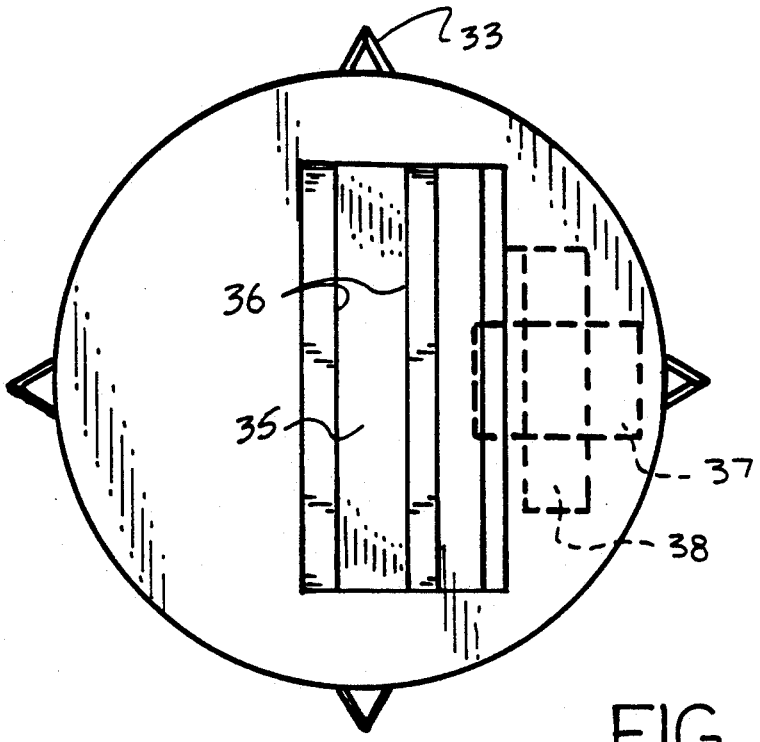
FIG. 7 is an orthographic view, taken along the lines 7-7 of FIG. 6 in the direction indicated by the arrows.

The FIGS. 6 and 7 indicate a modified housing structure, having a spring member 37 interposed within the housing between the housing side wall and a carbide reinforcing wall 39 that is hingedly mounted about a hinge 38 to the housing top wall 34 for imposing upon one of the carbide slot side walls 36 to enhance engagement with the cleats. Further, the carbide side walls may be constructed to include ferromagnetic material to enhance securement of the cleats within an individual housing 31.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by Letters Patent of the United States is as follows:

1. A shoe cleat guard, comprising, a body, having a first layer of a first durometer of hardness coextensive and contiguous with a second layer of a second durometer of hardness greater than said first durometer of hardness, and a third layer coextensive and contiguous with said second layer, with the third layer having a third durometer of hardness greater than said second durometer of hardness, the first layer having a first layer concave top wall arranged to receive cleat members of a sport shoe therewithin in a piercing relationship, and the third layer having a convex bottom wall for engaging of an underlying support surface, and the first layer includes a first layer first slot spaced from a first layer second slot, the second layer having a second layer first slot coextensive with and in communication with the first layer first slot, and the second layer having a second layer second slot coextensive with and in communication with the first layer second slot, and a connecting strap having a central web captured between the second layer and the third layer, with the central web including a first web projecting through the first layer first slot and the second layer first slot extending beyond the first layer top wall, and a second web having a second length greater than said first length projecting through the first layer second slot and the second layer second slot, with the first web having a first hook and loop fastener surface, the second web having a second hook and loop fastener surface arranged for engaging the first web hook and loop fastener surface, and at least one insert housing directed through the first layer into the second layer, wherein the insert housing includes an insert housing side wall having a plurality of barbed projections to secure the insert housing within the arcuate body, the housing having a housing top wall, with the housing top wall having a top wall slot directed into the housing, with the top wall slot including facing carbide slot side walls for sharpening of a cleat member directed into the top wall slot, and the housing includes a housing cavity, having a spring member interposed between the housing side wall and one of said carbide slot side walls, with a carbide reinforcing wall engaging said spring member interposed between said spring member and said at least one carbide slot side wall, with said carbide reinforcing wall having a hinge hingedly mounting the reinforcing wall to the housing top wall within the cavity.

* * * * *